US008646892B2

(12) United States Patent
Jones et al.

(10) Patent No.: US 8,646,892 B2
(45) Date of Patent: Feb. 11, 2014

(54) SOLID INK STICK DELIVERY APPARATUS USING A LEAD SCREW DRIVE

(75) Inventors: Brent R. Jones, Sherwood, OR (US); Frederick T. Mattern, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 229 days.

(21) Appl. No.: 13/334,513

(22) Filed: Dec. 22, 2011

(65) Prior Publication Data

US 2013/0162735 A1 Jun. 27, 2013

(51) Int. Cl.
*B41J 2/175* (2006.01)

(52) U.S. Cl.
USPC ..... 347/88; 347/99

(58) Field of Classification Search
USPC ..... 347/88, 99
See application file for complete search history.

(56) References Cited

U.S. PATENT DOCUMENTS

| | | | | |
|---|---|---|---|---|
| 5,510,821 | A | 4/1996 | Jones et al. | |
| 6,672,716 | B2 | 1/2004 | Jones | |
| 6,755,517 | B2 | 6/2004 | Jones et al. | |
| 6,761,443 | B2 | 7/2004 | Jones | |
| 6,840,613 | B2 | 1/2005 | Jones | |
| 7,147,691 | B2 | 12/2006 | Palmer | |
| 7,302,212 | B2 * | 11/2007 | Leute | 399/258 |
| 7,604,336 | B2 * | 10/2009 | Leighton | 347/88 |
| 7,942,515 | B2 | 5/2011 | Mattern et al. | |
| 2003/0202064 | A1 | 10/2003 | Jones et al. | |
| 2003/0202065 | A1 | 10/2003 | Jones | |
| 2003/0202066 | A1 | 10/2003 | Jones | |
| 2003/0202070 | A1 | 10/2003 | Jones | |
| 2003/0202075 | A1 | 10/2003 | Jones | |
| 2004/0201657 | A1 | 10/2004 | Jones et al. | |
| 2009/0160922 | A1 * | 6/2009 | Mattern et al. | 347/99 |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A solid ink stick delivery apparatus uses a rotating member mounted within a plurality of hollow sleeves to transport solid ink sticks to a melting device. The interior surface of the hollow sleeves are configured with a surface that frictionally engages the rotating member, but enables the member to slip past the interior surface when the hollow sleeve is stopped from proceeding along the length of the member.

20 Claims, 5 Drawing Sheets

SOLID INK STICK DELIVERY APPARATUS USING A LEAD SCREW DRIVE

TECHNICAL FIELD

The solid ink stick delivery systems disclosed below incorporate motive force to deliver solid ink sticks to a melting device, and, more particularly, incorporate a motive force that drives a lead screw for delivering solid ink sticks to a melting device.

BACKGROUND

Solid ink or phase change ink printers conventionally receive ink in various solid forms, such as pellets or ink sticks. The solid ink pellets or ink sticks are typically inserted through an insertion opening of an ink loader for the printer, and the solid ink is pushed or slid along a feed channel by a feed mechanism and/or gravity toward a melting device. The melting device heats the solid ink impinging on the device until it melts. The liquid ink is collected and delivered to a printhead for jetting onto a recording medium.

A common goal of all printers is an increase in the number of documents generated by the printer per unit of time. As the throughput of solid ink printers increase, the demand for a continuous supply of solid ink to the melting device also increases. The increased demand for solid ink has led to the development of energized drive trains for the feed mechanisms that deliver solid ink units to a melting device. For example, a lead screw, an endless belt, and other drive mechanisms may be located in a feed channel and coupled to a motor through a drive train. Selectively energizing the motor causes the drive mechanism to move and carry a solid ink unit resting on the drive towards the melting assembly. The motorized carrier more positively urges the solid ink towards the melting unit without the need for a more typical spring-loaded ink stick pushing block that imparts an urging force to the ink sticks that also has to overcome by the user to close the ink access cover after loading. Developing motorized delivery systems that efficiently deliver solid ink sticks is a desirable user interface improvement, particularly when more frequent access is required, as with high volume printing.

SUMMARY

A solid ink stick delivery apparatus includes a feed channel having a first end and a second end, the first end being configured to receive solid ink sticks and the second end being positioned proximate a melting device, a lead screw drive positioned proximate the feed channel, the lead screw drive comprising: a member having a first end and a second end, the member being parallel to the feed channel and the first end of the member being proximate the first end of the feed channel and the second end of the member being proximate the second end of the feed channel, and at least one ink stick carrier mounted about the member, the at least one ink stick carrier having a length that is less than a length of the member, the at least one ink stick carrier being configured to frictionally engage a portion of the member, and an actuator operatively connected to the member to rotate the member and the at least one ink stick carrier about the member until the member overcomes a force of frictional engagement with the at least one ink stick carrier and slips with respect to the at least one ink stick carrier.

A solid ink inkjet printer uses a solid ink stick delivery apparatus having a lead screw drive. The printer includes at least one printhead configured to receive melted ink from at least one melting device and to eject melted phase change ink onto an image receiving surface, and a solid ink delivery apparatus configured to deliver solid ink sticks to the at least one melting device, the solid ink delivery apparatus comprising: a feed channel having a first end and a second end, the first end being configured to receive solid ink sticks and the second end being positioned proximate a melting device, a lead screw drive positioned proximate the feed channel, the lead screw drive comprising: a member having a first end and a second end, the member being parallel to the feed channel and the first end of the member being proximate the first end of the feed channel and the second end of the member being proximate the second end of the feed channel, and at least one ink stick carrier mounted about the member, the at least one ink stick carrier having a length that is less than a length of the member, the at least one ink stick carrier being configured to frictionally engage a portion of the member, and an actuator operatively connected to the member to rotate the member and the at least one ink stick carrier about the member until the member overcomes a force of frictional engagement with the at least one ink stick carrier and slips with respect to the at least one ink stick carrier.

BRIEF DESCRIPTION OF THE DRAWINGS

A delivery system that uses a lead screw drive to transport solid ink sticks in a solid ink printer are discussed with reference to the following drawings.

DETAILED DESCRIPTION

Figure 1:
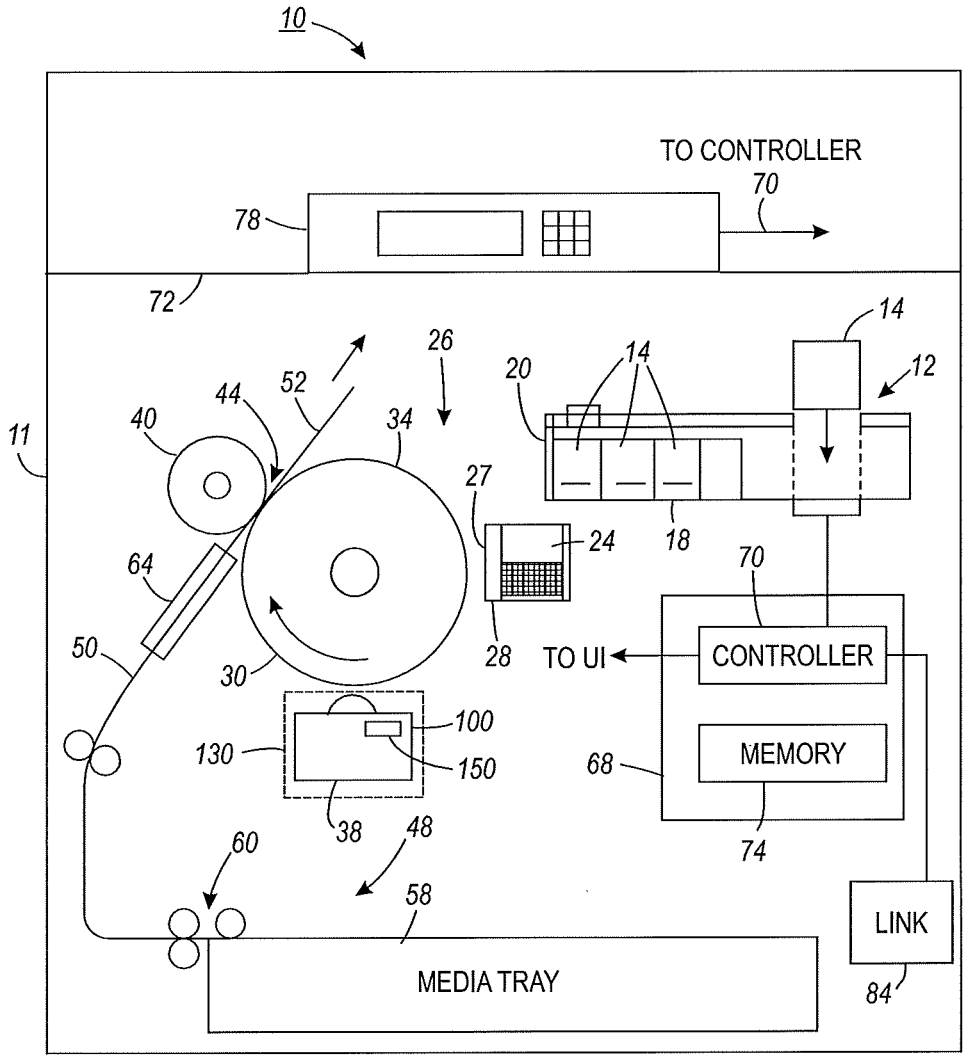
FIG. 1 is a schematic diagram of a solid ink inkjet printer in which the lead screw drive delivery apparatus has been incorporated.

For a general understanding of the present embodiments, reference is made to the drawings. In the drawings, like reference numerals have been used throughout to designate like elements. As used herein, the terms "printer" generally refer to an apparatus that produces an ink image on print media and encompasses any apparatus, such as a digital copier, bookmaking machine, facsimile machine, multi-function machine, etc., which produces ink images on media. The printer forms ink images on an image receiving surface, and the term "image receiving surface" as used herein refers to print media or an intermediate member, such as a drum or belt, which carries an ink image. "Print media" can be a physical sheet of paper, plastic, or other suitable physical substrate suitable for receiving ink images, whether precut or web fed. A printer may include a variety of other components, such as finishers, paper feeders, and the like, and may be embodied as a copier, printer, or a multifunction machine. An image generally includes information in electronic form, which is to be rendered on print media by a marking engine and may include text, graphics, pictures, and the like.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving surface, such as a print medium or the surface of an intermediate member that holds a latent ink image, moves past the printheads in a process direction through the print zone. The inkjets in the printheads eject ink drops in rows in a cross-process direction, which is perpendicular to the process direction across the image receiving surface.

FIG. 1 is a side schematic view of a phase change inkjet printer 10 that includes a housing 11 that supports and at least partially encloses an ink loader 12, a printing system 26, a media supply and handling system 48, and a control system 68. The ink loader 12, which is described in more detail below, receives and delivers solid ink to a melting device 20 for the generation of liquid ink. The printing system 26 includes a plurality of inkjet ejectors that is fluidly connected to the melting device 20 to receive the melted ink. The inkjet ejectors emit drops of liquid ink onto an image receiving surface 30 under the control of system 68. The media supply and handling system 48 extracts media from one or more supplies in the printer 10, synchronizes delivery of the media to a transfix nip for the transfer of an ink image from the image receiving surface to the media, and then delivers the printed media to an output area.

In more detail, the ink loader 12 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the printer 10. The feed channel 18 guides ink sticks 14 toward a melting device 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 80° C. to 130° C.

The melted ink from the melting device 20 is directed gravitationally or by pressurizing devices to a melt reservoir 24. A separate melt reservoir 24 can be provided for each ink color, shade, or composition used in the printer 10. Alternatively, a single reservoir housing can be compartmentalized to contain the differently colored inks. As depicted in FIG. 1, the ink reservoir 24 comprises a printhead reservoir that supplies melted ink to inkjet ejectors 27 formed in the printhead(s) 28. The ink reservoir 24 may be integrated into or intimately associated with the printhead 28. In alternative embodiments, the reservoir 24 may be a separate or independent unit from the printhead 28. Each melt reservoir 24 can include a heating element operable to heat the ink contained in the corresponding reservoir to a temperature suitable for melting the ink and/or maintaining the ink in liquid or molten form, at least during appropriate operational states of the printer 10.

The printing system 26 includes at least one printhead 28, which can be configured to eject multiple colors of ink. One printhead 28 is shown in FIG. 1 although any suitable number of printheads 28 can be used. The printhead 28 is operated in accordance with firing signals generated by the control system 68 to eject drops of ink toward an ink receiving surface. The device 10 of FIG. 1 is an indirect printer configured to use an indirect printing process in which the drops of ink are ejected onto an intermediate surface 30 and then transferred to print media. In alternative embodiments, the device 10 may be configured to eject the drops of ink directly onto print media.

The rotating member 34 is shown as a drum in FIG. 1 although in alternative embodiments the image receiving member 34 can be a moving or rotating belt, band, roller or other similar type of structure. A transfix roller 40 is loaded against the intermediate surface 30 on rotating member 34 to form a nip 44 through which sheets of print media 52 pass. The sheets are fed through the nip 44 in timed registration with an ink image formed on the intermediate surface 30 by the inkjets of the printhead 28. Pressure (and in some cases heat) is generated in the nip 44 to facilitate the transfer of the ink drops from the surface 30 to the print media 52 while substantially preventing the ink from adhering to the rotating member 34.

The media supply and handling system 48 of printer 10 transports print media along a media path 50 that passes through the nip 44. The media supply and handling system 48 includes at least one print media source 58, such as supply tray 58. The media supply and handling system also includes suitable mechanisms, such as rollers 60, which may be driven or idle rollers, as well as baffles, deflectors, pick mechanisms, and the like, that are configured to transport media along the media path 50.

Media conditioning devices can be positioned at various points along the media path 50 to thermally prepare the print media to receive melted phase change ink. In the embodiment of FIG. 1, a preheater 64 is utilized to bring print media on media path 50 to an initial predetermined temperature prior to reaching the nip 44. In various embodiments, the media conditioning devices, such as the preheater 64, use radiant, conductive, or convective heat or any combination of these heat forms to bring the media to a target preheat temperature, which in one practical embodiment, is in a range of about 30° C. to about 70° C. In alternative embodiments, other thermal conditioning devices are used along the media path before, during, and after ink has been deposited onto the media.

A control system 68 aids in operation and control of the various subsystems, components, and functions of the printer 10. The control system 68 is operatively connected to one or more image sources 72, such as a scanner system or a work station connection, to receive and manage image data from the sources and to generate control signals that are delivered to the components and subsystems of the printer. Some of the control signals are based on the image data, such as the firing signals, and these firing signals operate the printheads as noted above. Other control signals cause the components and subsystems of the printer to perform various procedures and operations for preparing the intermediate surface 30, delivering media to the transfix nip, and transferring ink images onto the media output by the imaging device 10.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage can be used. For example, the memory 74 can be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 can include a keypad and display (not shown). The controller 70 is operatively coupled to the user interface 78 to receive signals indicative of selections and other information input to the user interface 78 by a user or operator of the device. Controller 70 is operatively coupled to the user interface 78 to display information to a user or operator including selectable options, machine status, consumable status, and the like. The controller 70 can also be coupled to a communication link 84, such as a computer network, for receiving image data and user interaction data from remote locations. To facilitate transfer of an ink image from the drum to print media, the device 10 is provided with a drum maintenance unit (DMU) 100 for applying release agent as an intermediate surface 30 to the surface of the rotating member 34.

Figure 2:
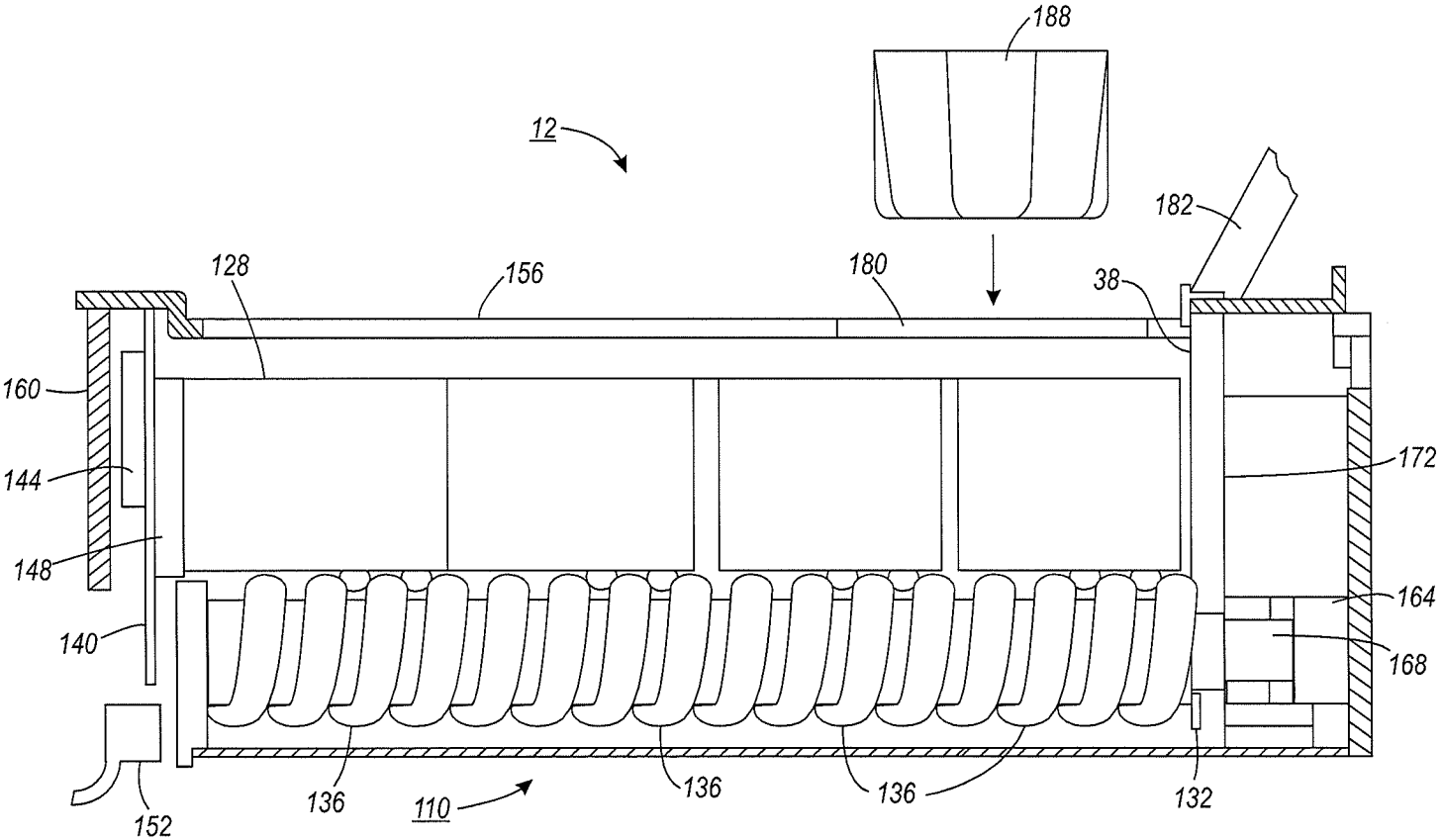
FIG. 2 is a cross-sectional view of a feed channel in the printer of FIG. 1 that depicts the lead screw driver transporting solid ink sticks.

In FIG. 2, the solid ink loader 12 includes a solid ink stick delivery device having a lead screw drive 110. The delivery device 110 includes a feed channel 128, a drive member 132, at least one ink stick carrier 136, and a melting plate 140. The melting plate 140 is heated by a heater 144 to a temperature that causes the leading edge 148 of an ink stick to melt. The liquid ink is collected at one end of the melt plate 140 where the ink drips into an ink reservoir. Other ink delivery components or systems can be used instead of or in addition to the melt plate. The feed channel 128 is a known structure in solid ink inkjet printers. The feed channel 128 is formed by an upper wall 156, side walls (not visible in the cross-sectional view of FIG. 2), and a back wall 160. The walls are configured to provide support and/or containment for a solid ink stick as the stick progresses from an insertion end of the feed channel to the end of the feed channel where the melting plate 140 is located. The upper wall 156 helps ensure the solid ink sticks remain in contact with the solid ink stick carriers 136. The upper wall 156 is provided with an opening 180 to enable an ink stick 188 to be inserted into the feed channel 128. The opening 180 is exposed when cover 182 is pivoted from a position overlying wall 156 to the position shown in FIG. 2.

The drive member 132 and the solid ink stick carriers 136 provide support for the bottom of the solid ink sticks as the sticks progress along the channel. As described in more detail below, the drive member and carriers need not be centered between the side walls of a feed channel to deliver the solid ink sticks to the melting device. The drive member 132 is a shaft having a first end and a second end. One end of the shaft is operatively connected to a rotational output of a actuator 164, such as an electrical motor. The actuator is operatively connected to the drive member 132 directly or by a mechanical linking mechanism 168 having one or more drive components, such as pulleys, belts, or gears arranged in a gear train. In one embodiment, each feed channel in a plurality of feed channels within a solid ink inkjet printer includes a drive member having one or more ink stick carriers mounted about the drive members. Each member is operatively connected to the same actuator. The gear train or power takeoff mechanism that operatively connects the actuator rotational output to a drive member can be selectively connected through a transmission that is operated by a controller for independent control of the drives in the channels. In another embodiment, the drive member in each feed channel remains operatively connected to the one actuator that rotates all of the drive members in the feed channels. In other embodiments, each drive member is operatively connected to an actuator in a one-to-one correspondence. End wall 172 includes an opening through which the drive member 132 extends. The opening, in some embodiments, includes a journal bearing to rotate with and support the drive member 132. The drive 110 is bi-directional to enable the ink stick carriers to travel in both directions with the feed channel.

Figure 3:
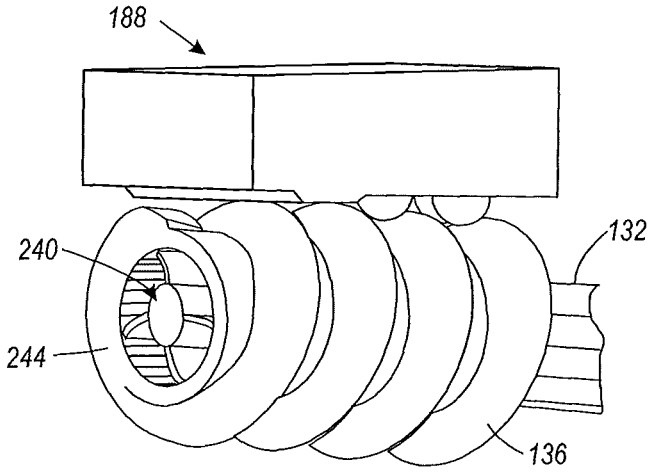
FIG. 3 is a perspective view of the lead screw drive shown in FIG. 2 depicting the relationship between a solid ink stick carrier and drive member.

As shown in FIG. 3, the drive member 132 is shown with one solid ink stick carrier 136 mounted about the member. A solid ink stick 188 rests on the carrier 136. The drive member includes at least one protuberance 240 that engages an interior surface 244 of the ink stick carrier 136. This relationship is described in more detail below. The protuberance in FIG. 3 is curved from the portion joining the shaft of the drive member to the outboard end that engages the interior surface 244. Alternative embodiments of the drive member 132 include at least one protuberance that is formed as a straight rib or a plurality of arms extending from the shaft to the interior surface. Additionally, the protuberance can be formed with a flexible material, such as silicone rubber, to enable the protuberance to slip along the interior surface of the ink stick carrier in response to the ink stick carrier abutting another ink stick carrier or a stop member at either end of the feed channel. Other methods of establishing limited friction or force transmission from the drive member 132 to the carrier 136 can be used. For example, a close tolerance fit with viscous material between the drive member and carrier can be used.

Figure 4:
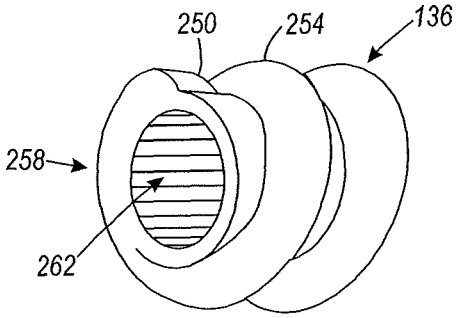
FIG. 4 is a perspective view of a solid ink stick carrier showing the interior surface of the carrier hollow body.
Figure 5:
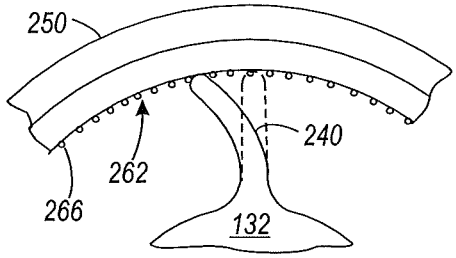
FIG. 5 is a schematic diagram of the interface between drive member and the solid ink stick carrier of FIG. 3.
Figure 6:
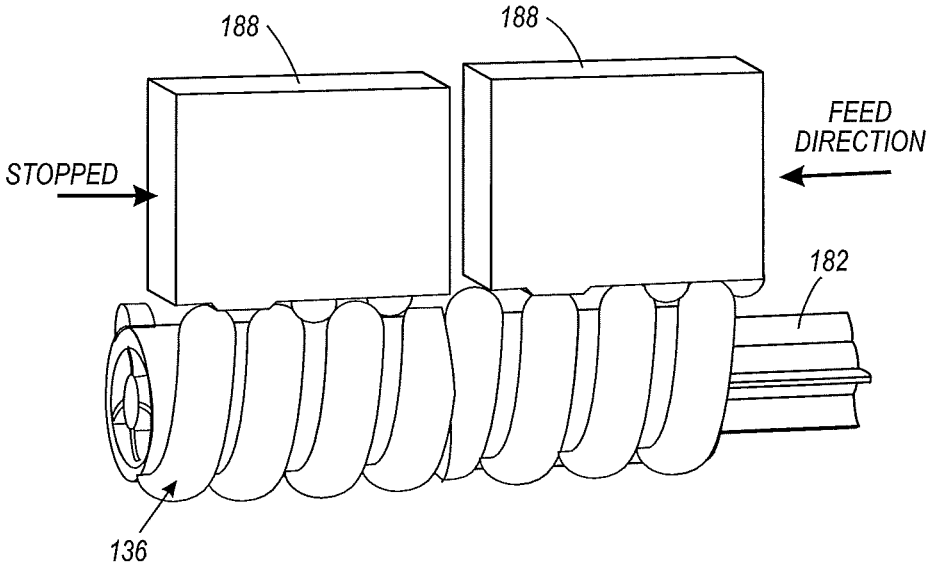
FIG. 6 is a perspective view of two unaligned solid ink stick carriers on a drive member.

One ink stick carrier is shown in FIG. 4. As used in this document, an ink stick carrier refers to a body that is configured to mount and rotate about a drive member while supporting a solid ink stick. The ink stick carrier 136 in FIG. 4 includes a hollow body 250 and circumferential threads 254 that encircle the body 250 in a pitched or angled manner. The pitch of the threads on the ink stick carriers need not be the same as the pitch of threads of other ink stick carriers mounted about the same or different drive members. The threads are configured to engage an exterior surface of a solid ink stick and impart a force to the ink stick supported by the carrier that urges the ink stick along the feed channel. The hollow body 250 is in the form of a cylinder having a lumen 258 through the cylindrical body. The interior surface 262 of the ink stick carrier 136 can be formed with longitudinal ribs 266 that produce an interrupted or scalloped surface as shown in FIG. 5. The ribs 266 extend sufficiently from the interior surface 262 that the rotating shaft can exert a rotational force on the carrier and rotate the carrier about the shaft. In response to an ink stick positioned on one carrier abutting another ink stick supported by an adjacent carrier, as shown in FIG. 1, the frictional force between the threads 254 and the carriers 236 impede rotation of the forward carrier while allowing the carrier behind the forward carrier to rotate until an ink stick positioned on that carrier is likewise prevented from rotation and forward motion. When the frictional force reaches a level that exceeds the force imparted by the rotating drive member, the protuberance 240 slips past the ribs of the scalloped surface of the hollow body and begins to rotate within the lumen 258 without rotating the carrier. The slipping effect is shown in solid lines in FIG. 5, while the non-slipping engagement is shown in phantom in FIG. 5. As mentioned, other structures can be used to limit force transmission between the drive member and the carrier.

The carriers can be substantially unaligned relative to the helical ink stick urging features until supported ink sticks are fully abutted. When this situation occurs, the helical features substantially align so that solid ink sticks can progress from one carrier to the next. In some embodiments, the carriers have a length that is approximately the same as the length of the ink sticks to be used with a given ink loader, although in other embodiments, the carriers can be longer or shorter than the length of the ink sticks to be used with the loader. Implementations of the ink loader can have ink feed channels configured to accommodate several ink sticks, which would be supported, in the described length relationship, by as many carriers. Each of the carriers remains substantially in the same place, other than rotationally, in the longitudinal length of the feed channel. The interior surface 262 in FIGS. 4 and 5 is shown with a scalloped surface formed with the longitudinal ribs. In other embodiments, the interior surface can be a textured surface, for example, formed with short nubs or a corduroy pattern during fabrication or the surface is prepared with machining to provide other structures that engage the protuberance extending from the drive member.

The lead screw drive formed by the drive member 112 and the carriers 116 propel ink sticks through a feed channel to transport the lead ink stick to the melting device. Ink sticks behind the lead ink stick are brought into contact with the rear portion of other solid ink sticks in the feed channel. As melting occurs, the forward progression of the ink sticks is slower than the rotation of the drive member would encourage if the supporting carrier were not limited to that rotation allowed by the melt rate. Rib like interruptions in rotation transmission between a steadily rotating drive member and the carriers mounted about the member can have a secondary benefit in encouraging ink sticks to overcome material feeding friction caused by multiple minor impact, such as jolts imparted by the frictional drive. The specific orientation and surface depictions set forth in this description are presented to aid understanding and visualizing of the function of the lead screw drive, however, other drive member and ink stick carrier configurations are possible.

Figure 7:
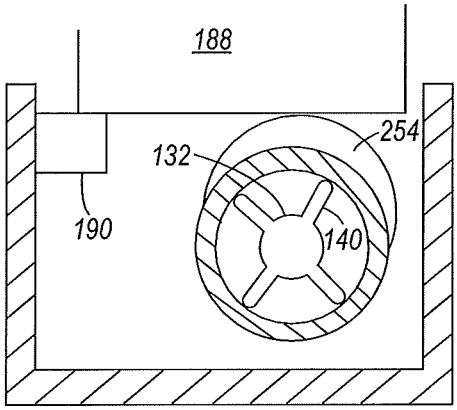
FIG. 7 is an end-on view of a feed channel in which the lead screw drive has been positioned asymmetrically with respect to the width of the feed channel.

FIG. 7 illustrates a view of a feed channel from an end of the channel. The lead screw drive is positioned closer to one side wall of the channel than it is to the other side wall. The rib 190 helps balance the solid ink stick as the stick is urged through the channel. Thus, the lead screw drive need not be centered in the feed channel to be effective.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A solid ink stick delivery apparatus comprising:

a feed channel having a first end and a second end, the first end being configured to receive solid ink sticks and the second end being positioned proximate a melting device;

a lead screw drive positioned proximate the feed channel, the lead screw drive comprising:

a member having a first end and a second end, the member being parallel to the feed channel and the first end of the member being proximate the first end of the feed channel and the second end of the member being proximate the second end of the feed channel; and at least one ink stick carrier mounted about the member, the at least one ink stick carrier having a length that is less than a length of the member, the at least one ink stick carrier being configured to frictionally engage a portion of the member; and an actuator operatively connected to the member to rotate the member and the at least one ink stick carrier about the member until the member overcomes a force of frictional engagement with the at least one ink stick carrier and slips with respect to the at least one ink stick carrier.

2. The solid ink stick delivery apparatus of claim 1 further comprising:

a plurality of ink stick carriers mounted about the member in an end-to-end serial manner.

3. The solid ink stick delivery apparatus of claim 1, the at least one solid ink stick carrier further comprising:

a hollow body having a cylindrical shape with a lumen centrally located in the hollow body, the member being positioned within the lumen of the hollow body.

4. The solid ink stick delivery apparatus of claim 3, the hollow body further comprising:

a textured surface that faces the lumen to frictionally engage the portion of the member.

5. The solid ink stick delivery apparatus of claim 4, the textured surface further comprising:

a scalloped surface.

6. The solid ink stick delivery apparatus of claim 4, the textured surface further comprising:

at least one rib extending into the lumen of the hollow body.

7. The solid ink stick delivery apparatus of claim 3, the member further comprising:

at least one protuberance extending outwardly from the member to frictionally engage the at least one ink stick carrier.

8. The solid ink stick delivery apparatus of claim 7 wherein the protuberance is comprised essentially of a flexible material.

9. The solid ink delivery apparatus of claim 7 wherein the protuberance is at least one rib that extends from approximately the first end of the member to approximately the second end of the member.

10. The solid ink delivery apparatus of claim 1 wherein the motor is bidirectional.

11. A phase change ink inkjet printer comprising:

at least one printhead configured to receive melted ink from at least one melting device and to eject melted phase change ink onto an image receiving surface; and a solid ink delivery apparatus configured to deliver solid ink sticks to the at least one melting device, the solid ink delivery apparatus comprising:

a feed channel having a first end and a second end, the first end being configured to receive solid ink sticks and the second end being positioned proximate a melting device;

a lead screw drive positioned proximate the feed channel, the lead screw drive comprising:

a member having a first end and a second end, the member being parallel to the feed channel and the first end of the member being proximate the first end of the feed channel and the second end of the member being proximate the second end of the feed channel; and at least one ink stick carrier mounted about the member, the at least one ink stick carrier having a length that is less than a length of the member, the at least one ink stick carrier being configured to frictionally engage a portion of the member; and an actuator operatively connected to the member to rotate the member and the at least one ink stick carrier about the member until the member overcomes a force of frictional engagement with the at least one ink stick carrier and slips with respect to the at least one ink stick carrier.

12. The printer of claim 11 further comprising:

a plurality of ink stick carriers mounted about the member in an end-to-end serial manner.

13. The printer of claim 11, the at least one solid ink stick carrier further comprising:

a hollow body having a cylindrical shape with a lumen centrally located in the hollow body, the member being positioned within the lumen of the hollow body.

14. The printer of claim 13, the hollow body further comprising:

a textured surface that faces the lumen to frictionally engage the portion of the member.

15. The printer of claim 14, the textured surface further comprising:

a scalloped surface.

16. The printer of claim 14, the textured surface further comprising:

at least one rib extending into the lumen of the hollow body.

17. The printer of claim 13, the member further comprising:

a protuberance extending outwardly from the member to frictionally engage the at least one ink stick carrier.

18. The printer of claim 17 wherein the protuberance is comprised essentially of a flexible material.

19. The printer of claim 17 wherein the protuberance is at least one rib that extends from approximately the first end of the member to approximately the second end of the member.

20. The printer of claim 11 wherein the motor is bidirectional.

* * * * *